United States Patent [19]

Baszczuk et al.

[11] Patent Number: 4,810,288

[45] Date of Patent: Mar. 7, 1989

[54] METHOD AND APPARATUS FOR MAKING METAL POWDER

[75] Inventors: Christopher M. Baszczuk, Clay; Bruce A. Quimby, Clayville, both of N.Y.

[73] Assignee: United Technologies Corporation, Hartford, Conn.

[21] Appl. No.: 188,762

[22] Filed: May 2, 1988

Related U.S. Application Data

[63] Continuation of Ser. No. 92,099, Sep. 1, 1987, abandoned.

[51] Int. Cl.[4] ..... B22F 9/08

[52] U.S. Cl. ..... 75/0.5 B; 75/0.5 C; 264/13; 425/6

[58] Field of Search ..... 75/0.5 B, 0.5 C; 425/6; 264/13, 14

[56] References Cited

U.S. PATENT DOCUMENTS

| | | | |
|---|---|---|---|
| 1,328,446 | 1/1920 | Adam . | |
| 2,402,441 | 6/1946 | Paddle | 83/91 |
| 2,638,424 | 5/1953 | Hansgirg | 134/3 |
| 3,049,421 | 8/1962 | Allen et al. | 75/0.5 |
| 3,165,396 | 1/1965 | Goon | 75/0.5 |
| 3,510,546 | 5/1970 | Wentzell | 264/13 |
| 3,588,071 | 6/1971 | Wentzell | 425/6 |
| 3,720,737 | 3/1973 | Klaphaak et al. | 264/8 |
| 4,040,815 | 8/1977 | Francois et al. | 75/0.5 B |
| 4,264,641 | 4/1981 | Mahoney et al. | 427/30 |
| 4,482,134 | 11/1984 | Uda et al. | 266/217 |
| 4,533,382 | 8/1985 | Miura et al. | 75/0.5 C |
| 4,533,383 | 8/1985 | Miura et al. | 75/0.5 C |
| 4,533,413 | 8/1985 | Miura et al. | 148/420 |
| 4,544,404 | 10/1985 | Yolton et al. | 75/0.5 C |
| 4,594,101 | 6/1986 | Miura et al. | 75/0.5 C |
| 4,610,718 | 9/1986 | Araya et al. | 75/0.5 C |
| 4,610,719 | 9/1986 | Wentzell | 75/0.5 C |

FOREIGN PATENT DOCUMENTS

| | | |
|---|---|---|
| 51-23463 | 7/1976 | Japan . |
| 59-159903 | 10/1984 | Japan . |

*Primary Examiner*—Wayland Stallard

*Attorney, Agent, or Firm*—James M. Rashid

[57] ABSTRACT

An apparatus and method for forming essentially contaminant free metal powders of varying particle diameter by utilizing a separate gas percolation chamber for admitting a separate clean variable pressure percolating gas into a molten metal passing through a transfer tube, forming a metal froth which is sprayed into a reduced pressure collection chamber. The metal froth then disintegrates providing a finely divided powder which is cooled in the suspension state and collected. By utilizing a separate percolation chamber for independently pressurizing the metal froth, impurities are reduced and froth characteristics and controllably modifiable thereby providing essentially contaminant free metal powder of varying particle diameter. In addition, pressure equalization means are disclosed for overcoming pressure imbalances on start-up. A valve filter combination provides for free gas flow between the percolation chamber and melting chamber, preventing overpressured molten metal from blocking the precolation holes during the initial metal froth formation, thereby increasing powder yields.

2 Claims, 3 Drawing Sheets

METHOD AND APPARATUS FOR MAKING METAL POWDER

This application is a continuation of U.S. application Ser. No. 092,099, filed Sept. 1, 1987, and now abandoned.

CROSS REFERENCE TO RELATED APPLICATIONS

This application is related to commonly assigned copending U.S. application titled "Method and Apparatus for Making Metal Powder", Ser. No. 07/093,276 filed on 09/04/87.

TECHNICAL FIELD

This invention relates to methods and apparatus for making metal powder by atomizing a molten metal utilizing a separate gas percolation system which includes initial pressure equalization means.

BACKGROUND ART

Various apparatus and methods are known in the art for producing metal powders. In commonly owned U.S. Pat. No. 3,588,071 to Wentzell, apparatus is disclosed which includes a melting chamber with a crucible disposed therein, means for melting a metal placed in the crucible, means for controlling the gas pressure in the melting chamber, a vacuum chamber disposed adjacent to the melting chamber, and an injection tube which extends from the melting chamber into the vacuum chamber for transporting the molten metal therethrough. The tube includes a plurality of holes in a portion thereof for percolating the melting chamber gas into the molten metal as it passes therethrough. This produces a metal froth which, upon discharge in the vacuum chamber, disintigrates into discrete metal particles, thereby producing a metal powder.

In utilizing the above-described apparatus, problems are encountered in controlling contamination of the metal powder. Various contaminants such as carbon, metallic vapors or ceramic particulates may be generated during the melting process and carried with the percolation gas into the froth, thereby contaminating the metal powder. Filters installed to remove the contaminants are quickly clogged, restricting gas flow and reducing powder yields.

In addition, utilizing the same gas to pressurize the melting chamber and to create the froth reduces the ability to vary powder size. As the chamber pressure increases, both the melt flow and the percolation rate increase, with the combination offsetting to produce an approximately consistent froth. To modify particle size, therefore, requires a change in the tube diameter and/or number and size of tube holes which requires substantial downtime to accomplish. Consequently, a need has arisen within the art to increase powder quality and yields, while providing increased controllability of powder size.

DISCLOSURE OF INVENTION

Separate Percolation Chamber

It is an object of the present invention to provide an apoaratus for producing metal powder which limits the addition of contaminants to the metal froth.

It is a further object of the present invention to provide a separate variable gas pressure chamber around the orifice portion of the injection tube for varying the percolation gas pressure without altering the metal flow rate, thereby controllably varying the particle size of the powder produced.

It is a further object of the present invention to provide a method for making essentially contaminant free metal powder of controllable particle size.

According to the present invention, an apparatus for making metal powder comprises a melting chamber, means for pressurizing the chamber, molten metal holding means, disposed within the melting chamber, a percolation chamber, disposed within the melting chamber and sealable therefrom, with means for variably pressurizing the percolation chamber independently of the melting chamber. Transport means extend from the melting chamber through the percolation chamber for transporting the molten metal therethrough. The transport means include a plurality of holes in the portion extending through the percolation chamber for admitting a gas, with the transport means extending into a reduced pressure collection chamber, disposed adjacent to the melting and percolation chambers. A molten metal is pressure driven from the melting chamber to the collection chamber with a separate percolation gas being injectable into the metal through the holes in the transport means, creating a metal froth therein. The froth, upon exiting the transport means in the collection chamber, disintegrates into discrete particles forming a metal powder.

The present invention further includes a method of making metal powder comprising: providing a molten metal in a crucible disposed in a melting chamber; pressurizing the melting chamber, driving the molten metal through a tube contactable therewith, with the tube including aplurality of holes in a portion thereof; variably pressurizing a percolation chamber, which sealably surrounds the porous portion of the tube, with a clean gas, which mixes with the molten metal in the tube, thereby forming a metal froth; and, discharging the metal froth in a reduced pressure collection chamber.

By providing a separate percolation chamber which surrounds the orifices of the transport tube, an independent, clean, pressure controllable gas is injectable therethrough, reducing contamination of the molten metal by impurities in the gas stream while providing variable control of the type of froth produced. This allows essentially contaminant-free metal powder of controllable particle size to be formed.

Pressure Equalization Means

It is a another object of the present invention to include initial pressure equalization means between the melting chamber and the separate percolation chamber during start-up to reduce hole blockage.

It is a further object of the present invention to provide a method for reducing hole blockages during froth initiation.

According to the present invention, an apparatus is disclosed for improving powder yields by reducing hole blockage during start-up. The apparatus comprises equalization means for providing free gas flow between the melting chamber and percolation chamber on start-up, with means for filtering the gas flowing therethrough. One embodiment comprises a valve/filter combination which is open during start-up to provide free flow of gas between the chambers, with the filter preventing contaminants from mixing with the clean percolation gas. The method involves providing for free flow of gas between the two chambers for a sufficient duration to initiate froth formation, filtering the gas flowing therebetween and blocking the free flow once the initial froth is formed. The incorporation of this method provides a significant increase in productivity by preventing hole blockage during start-up.

BEST MODE FOR CARRYING OUT THE INVENTION

Separate Percolation Chamber

Figure 1:
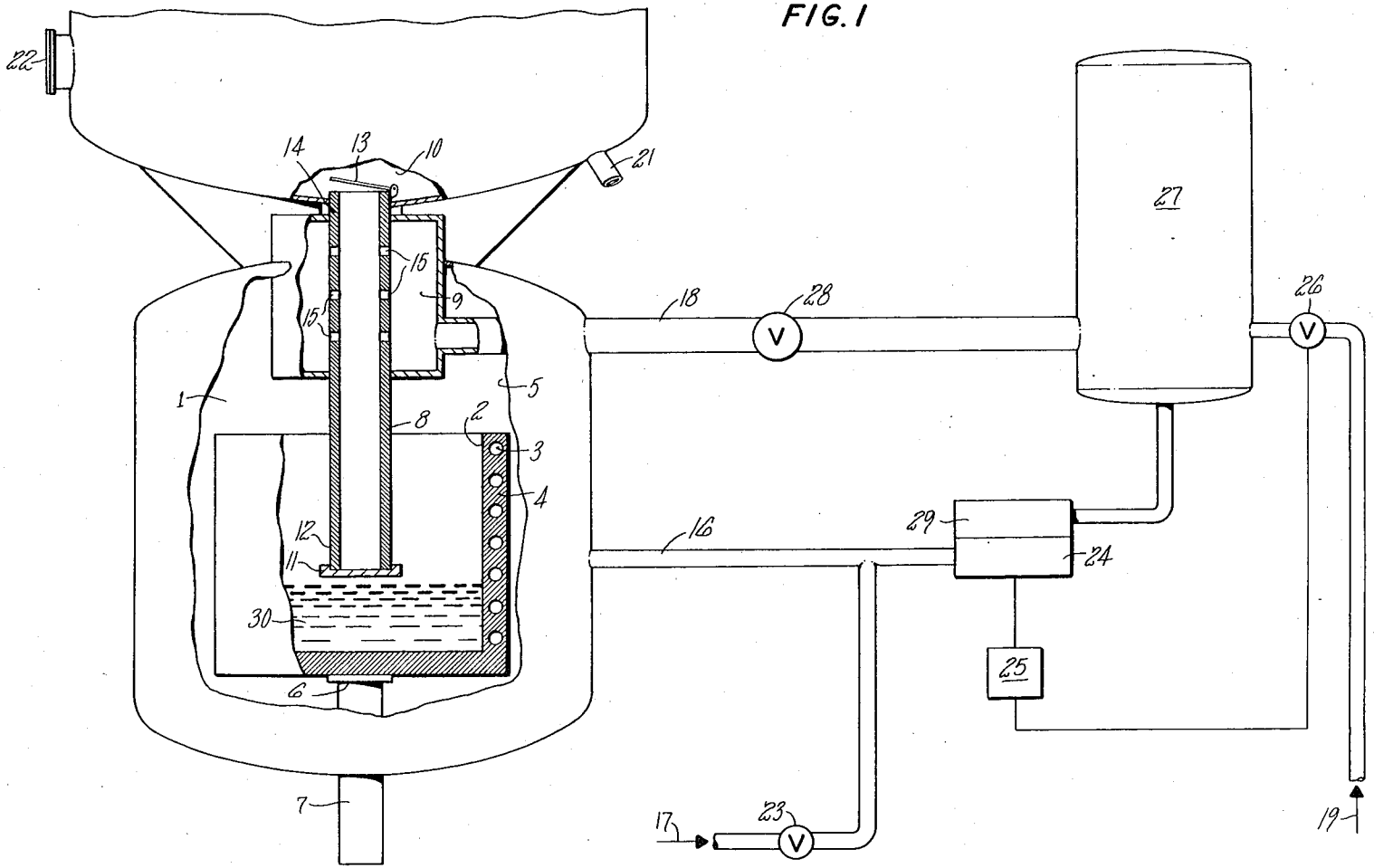
FIG. 1 is a side view of the metal producing apparatus of the present invention including a separate gas percolation system.

Referring to FIG. 1, a metal powder making apparatus is shown which incorporates the inventive separate gas percolation system. A melting chamber 1 includes a crucible 2 which is surrounded by an induction coil 3. The crucible and coil are further surrounded by a protective wall 4 which provides temperature protection for the melting chamber wall 5. For illustrative purposes, the crucible is located on the piston end 6 of a reciprocating ram 7 which moves the crucible into proximity with a transfer tube 8. The tube 8 extends through a percolation chamber 9, which is sealably disposed within the melting chamber 1, into a collection chamber 10. The tube includes a first seal 11 at the melting chamber end 12 and a second seal 13 at the collection chamber end 14. Generally, the first seal is heat destructible upon contact with the molten metal, with the second seal mechanically operated. This allows maintaining the separate chambers at different pressures during start-up. Of course, the choice of seal type and actuation method is left to the artisan. Each chamber is, therefore, sealable from the other chambers. The tube 8 also includes a plurality of holes 15 in the portion of the tube disposed within the percolation chamber 9. Such holes allow mixing of a percolation gas with a molten metal moving therethrough, thereby creating a metal froth.

The melting chamber 1 includes an inlet pipe 16 through which a melting chamber pressurization gas 17 may be admitted. Such a gas may comprise any nonoxidizing, nonreactive gas such as argon, helium or nitrogen. The percolation chamber 9 similarly has an inlet pipe 18 for admitting a separate percolation gas 19, with the pipe extending through the wall 5 of the melting chamber 1. The collection chamber 10 includes a pipe 21 for depressurizing the collection chamber, as it is preferred to discharge the metal froth into a vacuum or reduced pressure environment. An access port 22 is provided in the collection chamber to allow removal of the metal powder.

Referring still to FIG. 1, a control system is shown for variably controlling the percolation gas pressure. The gas 17, for example, argon, helium or nitrogen, is supplied from a source (not shown) to a regulator valve 23. The regulator valve, which self-monitors and adjusts the melting chamber pressure, is disposed in the pipe 16 for pressurizing the melting chamber 1. The gas is also supplied to a pressure transmitter 24 which transmits a gas pressure signal to a controller 25. The gas 19, which may also be argon, helium or nitrogen is supplied from a source (not shown) to a control valve 26. Between the control valve and the percolation chamber, an optional accumulator tank 27 may be disposed for dampening pressure pulses which are induced as the valve 26 alternately admits or blocks gas flow, as well as to maintain percolation pressure during high gas demand periods, thereby increasing the homogeneity of the gas/metal mix. A block valve 28 is used to isolate the percolation gas from the percolation chamber when not in use. The gas 19 is also supplied to a pressure transmitter 29 which transmits the percolation gas pressure signal to the controller 25. The controller 25 monitors the melting chamber pressure and percolation gas pressure and drives the control valve for adjusting the percolation gas pressure to a desired value. While separate gases supplied from independent sources are shown, a single supply gas may be utilized provided separate, controls are used to allow independent variation of the percolation gas pressure.

In operation, a quantity of metal 30 is added to the crucible 2, and the induction coils 3 charged to initiate melting. The melting chamber 1 is then sealed and pressurized with the melting chamber pressurization gas 17 through the regulator valve 23. Once complete melting has occurred, the crucible is driven by the ram 7 upwardly into proximity with the melting chamber end 12 of the transfer tube 8. The block valve 28 is then opened and the desired percolation gas pressure set using the controller 25, pressurizing the accumulation tank and the percolation chamber. The collection chamber 10 is then depressurized and the tube unsealed in the collection chamber 10, admitting the percolation gas to the collection chamber. As the molten metal rises through the tube, it passes the plurality of holes 15 in the tube, causing the separate percolation gas to mix with the molten metal, thereby forming a metal froth. The metal froth then exits the tube, spraying into the reduced pressure collection chamber. Such a discharge causes the pressurized metal froth to virtually explode in the vacuum chamber, providing a finely divided powder which is cooled in the suspended state and collected in the collection chamber. The metal powder is then collected and removed.

Pressure Equalization Means

Figure 2:
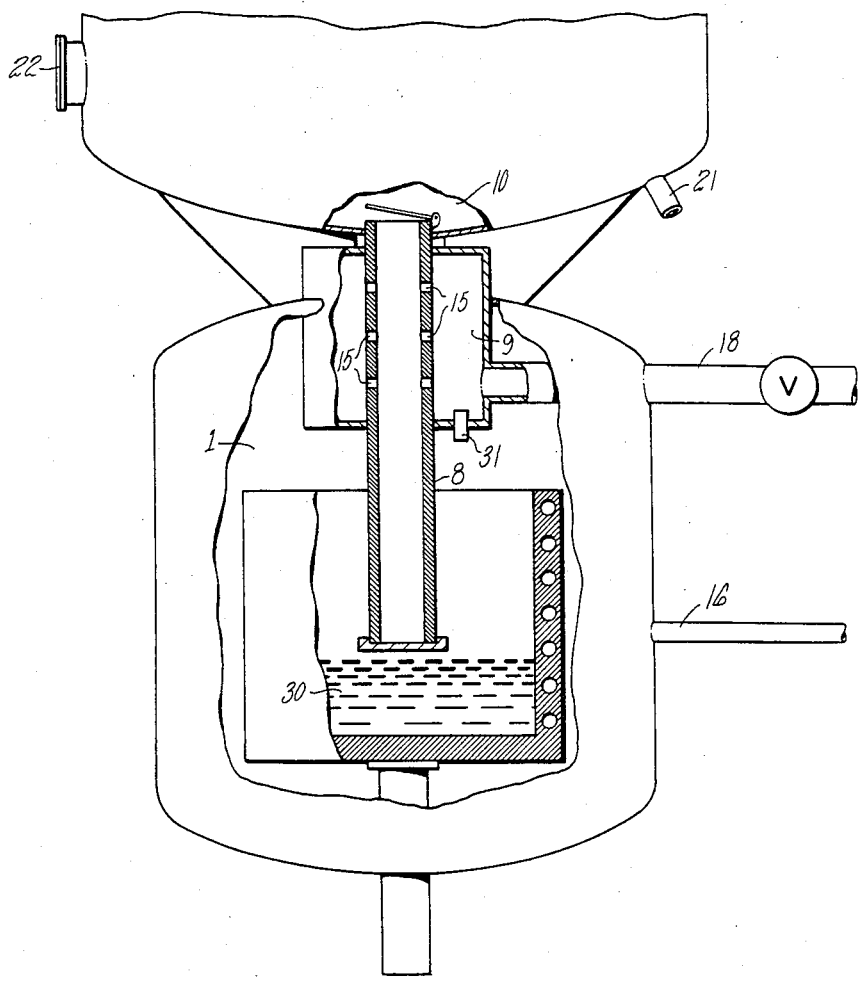
FIG. 2 is a side view of the metal producing apparatus of the present invention including a pressure equalization valve between the melting chamber and percolation chamber.

Referring now to FIG. 2, a side view of the metal producing apparatus of the present invention is shown including a pressure equalization valve 31 between the melting chamber 1 and the percolation chamber 9. This valve allows the free flow of gas between the melting chamber and the percolation chamber, thereby equalizing the pressure therebetween on start-up. The valve 31 also includes internal filtering means for preventing the contamination of the clean percolation gas with furnace contaminants. This valve/filter combination is required since it has been found that even with the above-described separate percolation chamber pressure control system, a pressure imbalance which occurs on start-up could allow molten metal to solidify in some of the tube holes during froth initiation, reducing powder yields.

A review of the system on start-up is illustrative of the advantages of the present invention. At the beginning of an atomization run, when molten metal 30 has started to move upward through the transfer tube but has not yet reached the percolation holes, a very high demand for percolation gas exists since there is unobstructed flow from the percolation chamber 9 through the percolation holes 15 into the tube 8 and then into the powder collection tank 10. The duration of this high demand condition is partially dependent on the distance the molten metal must travel prior to reaching the percolation holes. Once the molten metal stream reaches the percolation holes, it restricts flow of percolation gas into the transfer tube. Thus, at this point, a much lower percolation gas demand exists.

If the demand rate for percolation gas is greater than the supply rate, which can occur during periods of high demand such as before the molten metal reaches the percolation holes, i.e. during start-up, the gas pressure in the percolation chamber may decrease below the melting chamber pressure. If the percolation chamber is isolated from the melting chamber, then the pressure of the molten metal stream inside the transfer tube will be greater than that in the percolation chamber and molten metal will flow out of the transfer tube through the percolation holes. This can result in complete blockage of some of the percolation holes and decreased yield. If on the other hand, a connecting valve provides an open gas path between the percolation chamber and the melting chamber, the percolation gas pressure and the melting chamber pressure will remain equal and no metal will be forced out through the percolation holes. Then, once the gas demand is decreased to lower levels and the supply is sufficient, the connecting valve can be closed, isolating the percolation chamber with no resultant decrease in percolation pressure.

Figure 3:
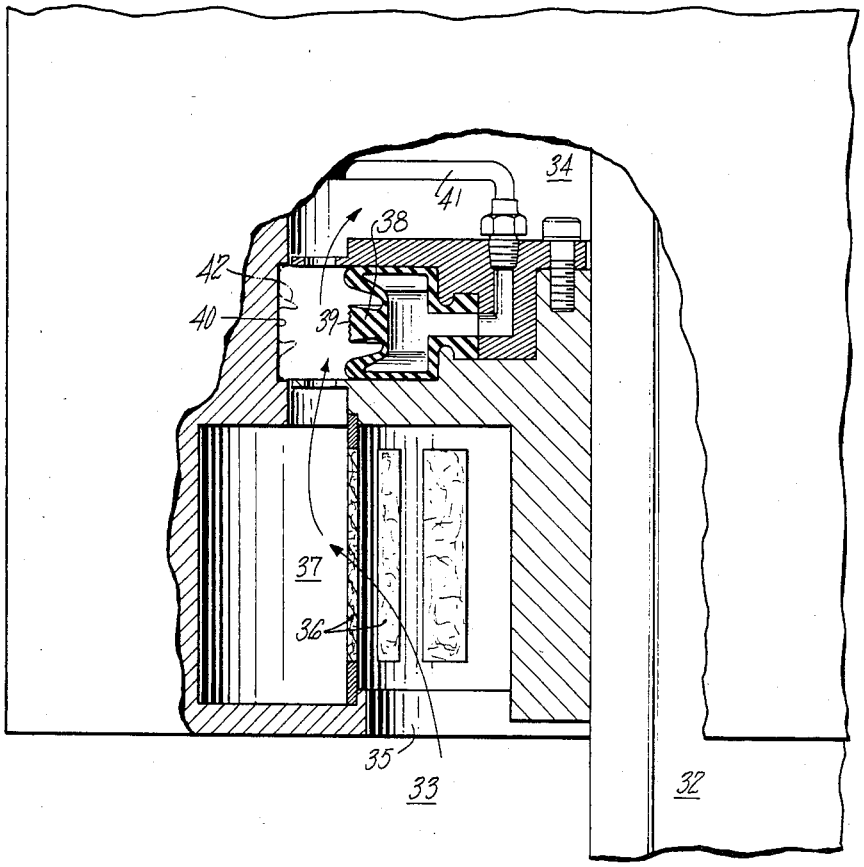
FIG. 3 is an enlarged view of a particular valve/filter apparatus usable for initial pressure equalization between the chambers.

Refering to FIG. 3, an embodiment of a valve/filter combination is shown. A transfer tube 32 extends from a melting chamber 33 into a percolation chamber 34. An annular opening 35 surrounds the tube 32, leading to a filter wall 36 composed of any suitable filter media. A receiving duct 37 is disposed adjacent to the filter wall for providing gas to flow into or out of the percolation chamber 34. An inflatable valve 38, including a seal surface 39, is disposed within the duct wall, opposite from a mating surface 40. During start-up, gas flows freely between the two chambers. Once froth formation has been initiated, the valve 38 is inflated through a tube 41, with, the seal surface 39 driven into contact with the mating surface, blocking gas flow. The sealed valve is illustrated by a phantom line 42.

By providing a free flow gas path that connects the melting and percolation chambers during the initial high gas demand period of an atomization run, then allowing isolation of the two chambers once initial transients in gas demand is over, metal injection through the percolation holes is eliminated and powder yields are maximized. Utilizing the above-described valve/filter combination in a metal powder producing apparatus results in a substantial increase in productivity, significantly reducing run time while improving powder quality.

While preferred embodiments of the present invention has been shown and described, it will be understood by those skilled in the art that various changes in terms of hole size, tube diameter, metal used, pressure control means, pressure equalization means and filter means could be made without varying from the scope of the present invention.

We claim:

1. An improved method of making a metal powder which includes the steps of (1) providing a molten metal in a crucible disposed in a melting chamber, (2) pressurizing said melting chamber, driving said molten metal through a tube contactable therewith, the tube including a plurality of holes in a portion thereof; (3) separably and variably pressurizing a percolation chamber which sealably surrounds the porous portion of said tube, said chamber pressurized with a clean percolation gas, said gas then mixing with the molten metal in the tube, forming a metal froth; and (4) discharging the metal froth in a collection chamber, said froth disintegrating to form a metal powder, wherein the improvement comprises providing for the free flow of gas between the melting chamber and percolation chamber until froth formation is initiated;

filtering the gas flowing between the chambers; and, blocking the free flow once the froth is formed.

2. An improved apparatus or making a metal powder comprising a melting chamber; means for pressurizing said chamber; molten metal holding means, disposed within said melting chamber; a pressure reducible collection chamber, adjacent to said melting chamber; transport means extending from said melting chamber to said collection chamber, said means being contactable by said molten metal for transporting said metal therethrough, said transport means including a plurality of holes in a portion thereof for admitting a gas therethrough, said molten metal being movable from said melting chamber through said transport means to said collection chamber by pressurization of said melting chamber; a percolation chamber, disposed within said melting chamber about the porous portion of said transport means; and, means for variably pressurizing said percolation chamber independently of said melting chamber, enabling a separate clean gas to be injectable into said metal within said transport means, mixing with said metal and thereby forming a controllable metal froth, said froth disintegrating into discrete paricles upon discharge in said collection chamber, forming a metal powder, wherein the improvement comprises:

pressure equalization means, disposed between said percolation chamber and said melting chamber, for providing or blocking gas flow therebetween; and filtering means, integral with said equalization means, for filtering any gas flowing therethrough, thereby preventing contamination of the percolation gas by impurities generated in the melting chamber.

* * * * *

UNITED STATES PATENT AND TRADEMARK OFFICE

CERTIFICATE OF CORRECTION

PATENT NO. : 4,810,288

DATED : March 7, 1989

INVENTOR(S) : Christopher M. Baszczuk and Bruce A. Quimby

It is certified that error appears in the above-identified patent and that said Letters Patent is hereby corrected as shown below:

In the ABSTRACT:

On line 12, replace "and" with --are--.

On line 19, replace "precolation" with --percolation--.

In DISCLOSURE OF INVENTION

In Column 1, line 64, replace "apoaratus" with --apparatus--.

In Column 2, line 34, replace "aplurality" with --a plurality--.

In CLAIM 2:

On line 29, replace "or" with --for--.

In Claim 2:

On line 49, replace "paricles" with --particles--.

Signed and Sealed this

Thirtieth Day of April, 1991

*Attest:*

*Attesting Officer*

HARRY F. MANBECK, JR.

*Commissioner of Patents and Trademarks*